US007584763B2

(12) United States Patent
Yoon

(10) Patent No.: US 7,584,763 B2
(45) Date of Patent: Sep. 8, 2009

(54) COLLAPSIBLE FRAME FOR PORTABLE SHELTER

(75) Inventor: Kern Sik Yoon, Sangju (KR)

(73) Assignee: TBA Corporation, Sangju, Kyungbuk (KR)

( * ) Notice: Subject to any disclaimer, the term of this patent is extended or adjusted under 35 U.S.C. 154(b) by 364 days.

(21) Appl. No.: 11/701,018

(22) Filed: Feb. 1, 2007

(65) Prior Publication Data

US 2008/0029143 A1 Feb. 7, 2008

(51) Int. Cl.
*E04H 15/38* (2006.01)
*E04H 15/50* (2006.01)

(52) U.S. Cl. ..... 135/131; 135/145; 135/151

(58) Field of Classification Search ..... 135/128, 135/131, 136, 138, 139, 140, 143, 145, 151
See application file for complete search history.

(56) References Cited

U.S. PATENT DOCUMENTS 3,670,747 A 6/1972 Pohl et al.
4,111,217 A * 9/1978 Victor ..... 135/114
4,707,953 A 11/1987 Anderson et al.
4,800,597 A 1/1989 Healey
5,331,777 A * 7/1994 Chi-Yuan ..... 52/64
5,584,311 A * 12/1996 Schaefer ..... 135/128
5,943,387 A 8/1999 Esser et al.
6,390,110 B1 5/2002 Brown
6,953,127 B1 10/2005 Esser
7,131,236 B2 11/2006 Sample et al.
2003/0164185 A1* 9/2003 Price ..... 135/131

* cited by examiner

*Primary Examiner*—David Dunn
*Assistant Examiner*—Danielle Jackson
(74) *Attorney, Agent, or Firm*—Wegman, Hessler & Vanderburg

(57) ABSTRACT

A portable shelter having a frame that is separately collapsible in a transverse direction and a longitudinal direction of the shelter to facilitate transportation and storage of the shelter. The frame includes a plurality of ribs, each rib comprising two support legs and at least three roof members forming a generally inverted U-shape when in an erect configuration. The support legs and the roof members are connected with foldable joints such that each rib may be collapsed in the transverse direction to a collapsed configuration wherein width of the rib is narrower in the collapsed configuration than when in the erect configuration. The frame also includes a wall support system connecting adjacent ribs. The wall support system is collapsible in the longitudinal direction to adjust the relative position between adjacent ribs.

13 Claims, 6 Drawing Sheets

COLLAPSIBLE FRAME FOR PORTABLE SHELTER

BACKGROUND OF THE INVENTION

1. Field of Invention

This invention relates to the field of portable shelters, and more particularly, to a shelter frame that can be rapidly deployed and erected while providing superior strength and durability.

2. Description of Related Art

It is known to erect portable shelters during times of emergency for use as command shelters, decontamination stations, mobile hospitals and temporary housing. These shelters, commonly referred to as emergency portable shelters, desirably are easy and quick to deploy and take down. They also should be lightweight to permit easy transportation, yet be extremely durable because of their use in inclement weather including high wind and heavy rainfall. Ideally, these portable shelters are free-standing. One example of a shelter is illustrated in commonly assigned Korean Patent Application No. 10-2005-0113339.

Many governmental and rescue agencies and organizations provide such portable shelters in emergency situations and large event staging areas. However, most of the traditional shelter frames are so weak that the parts are easily broken and the shelter itself is eventually rendered useless after transport or use. Additionally, the shelters typically are complicated and inconvenient to use and require much time and man power to set up and take down. Most of conventional shelter frames require an added extra support poles or guy wires to be installed after set up. It would be desirable to have an improved lightweight, sturdy, free-standing, quickly erectable and strikable all-purpose utility structure.

SUMMARY OF THE INVENTION

This invention is for a shelter frame which, when combined with a fabric canopy, can be used outdoors or in large indoor areas and is designed to provide added stability and durability. By unfolding and spreading the frame components, this shelter frame can be deployed quickly with minimal personnel. One of the features of this invented shelter frame is its rapid deployment. Because the frame can be erected quickly and folded and taken down in a few minutes, it is properly suited to use under emergency conditions for command shelters, military shelters, decontamination shelters and temporary housing.

One aspect of the invention is directed to a portable shelter having a frame that is separately collapsible in a transverse direction and a longitudinal direction of the shelter to facilitate transportation and storage of the shelter. The frame includes a plurality of ribs, each rib having two support legs and a roof made of roof members forming a generally inverted U-shape when in an erect configuration. The support legs and the roof members are connected with foldable joints such that each rib may be collapsed in the transverse direction to a collapsed configuration wherein width of the rib is narrower in the collapsed configuration than when in the erect configuration. The frame also includes a wall support system connecting adjacent ribs. The wall support system is collapsible in the longitudinal direction to adjust the relative position between adjacent ribs.

In one embodiment, the wall support system is a dual X-connection system made of a plurality of crossing elongate connection members, wherein one end of each side of the X-connection system has a slide block with a runner that is slideably mounted in a guide in a support leg and the other end of each side of the X-connection system is fixed to the support leg such that one end of the X-connection system moves freely upward or downward relative the other end to permit expanding and narrowing of the X-connection system to adjust the relative position of adjacent ribs.

In one embodiment, each rib has two outer roof members that are of a length substantially equal to the length of the first leg portions and a third shorter middle roof member positioned in-between the two outer roof members. The rib may be collapsed such that the support legs are folded inward to be adjacent the outer roof members and the outer roof members are folded with respect to the inner roof member such that the support legs and roof members are adjacent each other and in a generally parallel condition.

BRIEF DESCRIPTION OF THE DRAWINGS

The structure, operation, and advantages of the presently disclosed embodiment of the invention will become apparent when consideration of the following description taken in conjunction with the accompanying drawings wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
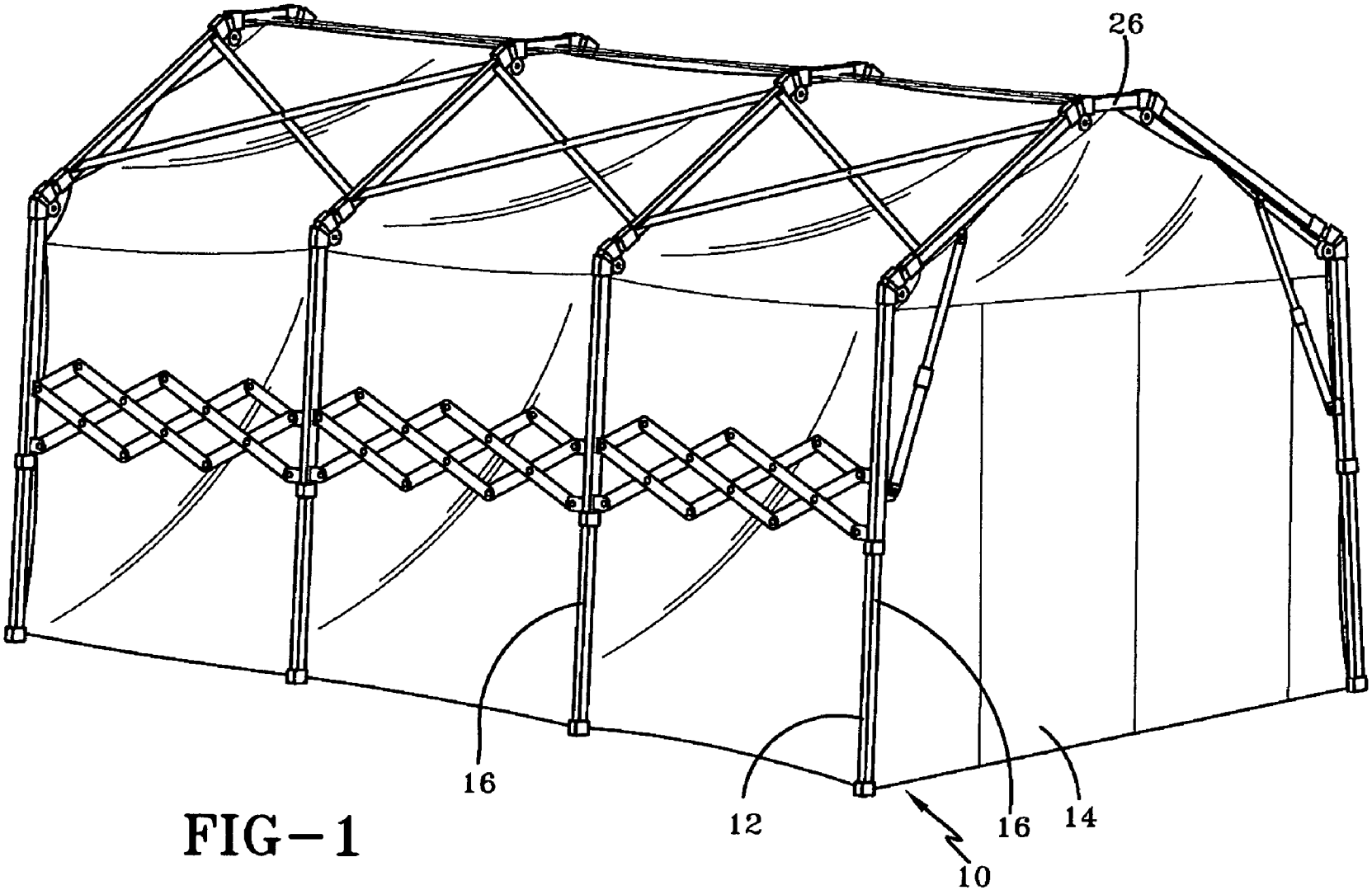
FIG. 1 illustrates a perspective view of a shelter according to one embodiment of the invention.

Referring now to the drawings, FIG. 1 shows a lightweight yet sturdy free-standing portable shelter, indicated generally by numeral 10, according to one embodiment of the invention. The shelter 10 comprises a rigid frame 12 that supports a shelter canopy 14. The frame 12 is desirably made from aluminum and/or plastic injection molding. The canopy 14 is desirably made of nylon, polyester, or other suitable material. In one desirable embodiment, the canopy 14 is made from 200 denier nylon coated with polyurethane and has vinyl windows.

Figure 2:
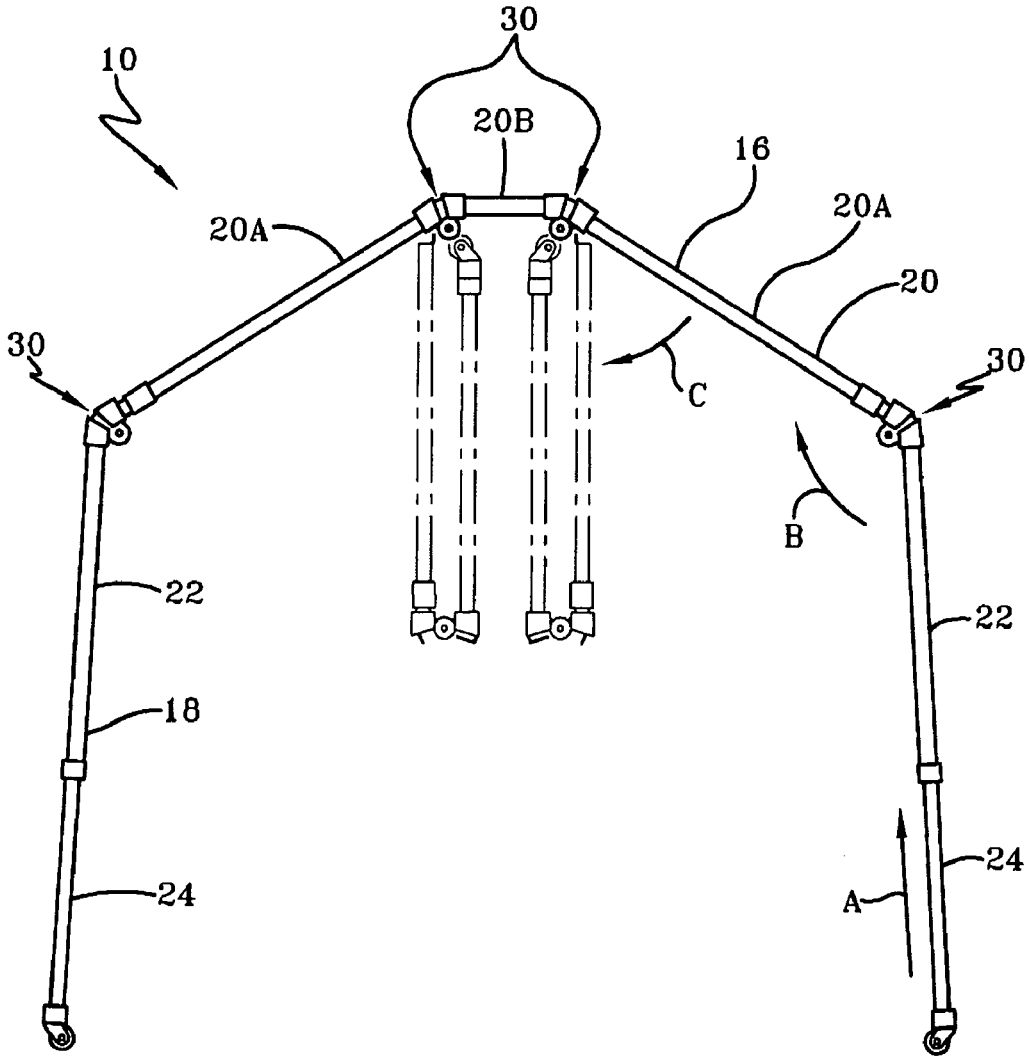
FIG. 2 illustrates a front view of a frame of the shelter of FIG. 1 with the frame shown in a collapsed state in phantom.

The frame 12 has a number of ribs 16 spaced along the length of the erect shelter 10. As best seen in FIG. 2, each rib 16 has a pair of support legs 18 connected by a roof portion 20 such that the rib 16 has a generally inverted U-shape. The support leg 18 desirably comprises a first leg portion 22 having a first diameter and a second leg portion 24 having a smaller diameter such that the second leg portion 24 may be received into and extended from the first leg portion in a telescoping manner when collapsing or erecting the shelter as shown by arrow A in FIG. 2. The first and second portions 22, 24 of the support leg 18 are locked in the extended position with a conventional locking mechanism (not shown). The locking mechanism may use locking pin, locking collar and the like known to one skilled in the art and selected using sound engineering judgment.

In the illustrated embodiment, the roof portion 20 of each rib 16 comprises two outer roof members 20A that are of a length substantially equal to the length of the first leg portions 22 and a third shorter middle roof member 20B positioned in-between the two outer roof members 20A. An apex of the canopy 14 is connected, such as with a strap or loop 26 (seen in FIG. 1), to the middle roof member 20B and similar loops or straps placed at suitable intervals connect the canopy to the outer roof members 20A and support legs 18. The support legs 18 are connected to the outer roof members 20A and the outer roof members 20A are connected to the inner roof member 20B with foldable joints 30 such that the rib 16 may be folded to a collapsed configuration as shown in phantom in FIG. 2 to facilitate transportation and storage of the shelter 10. When the shelter 10 is in the erected or raised condition, the support legs 18 and roof members 20A, 20B are connected such that each joint 30 forms a greater than 90 degree angle. These joints 30 help form the designed shape of the roof portion 20 of the shelter 10 and enable smooth folding and unfolding.

In the illustrated embodiment, each rib 16 has four joints 30 where folding is desired at the junctures of the support legs 18 and roof members 20A, 20B. There are two joints 30 where the respective outer roof members 20A meet the inner roof member 20B along the top of the rib 16. These two joints 30 and the length of the inner roof member 20B are designed to allow each rib 16 to be folded such that the support legs 18 are folded inward to be adjacent the outer roof members 20A as shown by the arrow B in FIG. 2 and the outer roof members 20A are folded with respect to the inner roof member 20B as shown by arrow C such that the support legs 18 and roof members 20A are adjacent each other and in a generally parallel condition as shown in phantom in FIG. 2.

Figure 3:
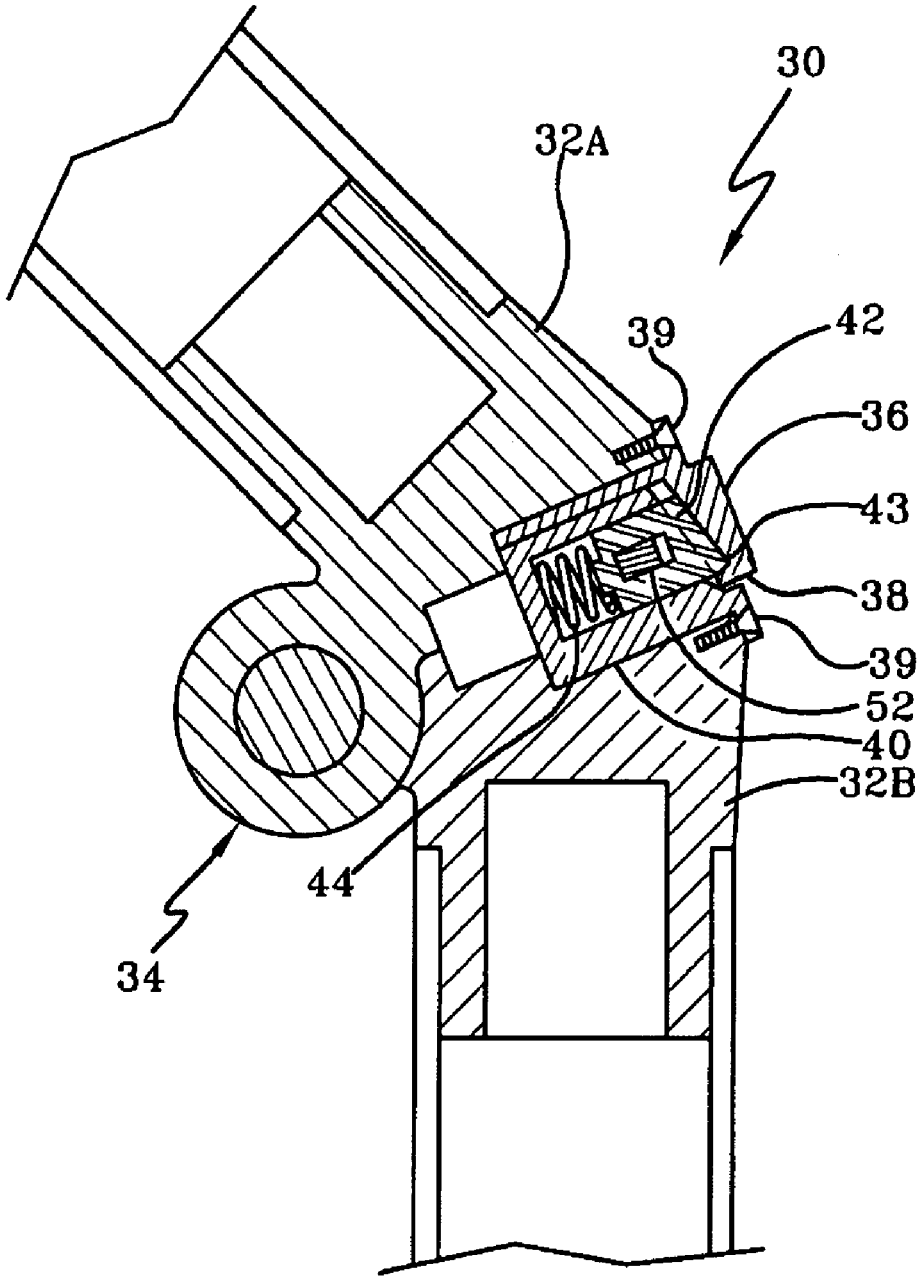
FIG. 3 a section of a joint of the frame of FIG. 2
Figure 4:
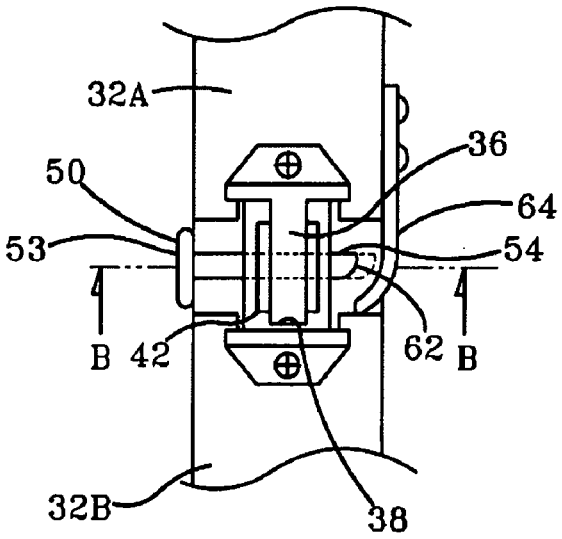
FIG. 4 is the side view of the joint of FIG. 3.
Figure 5A:
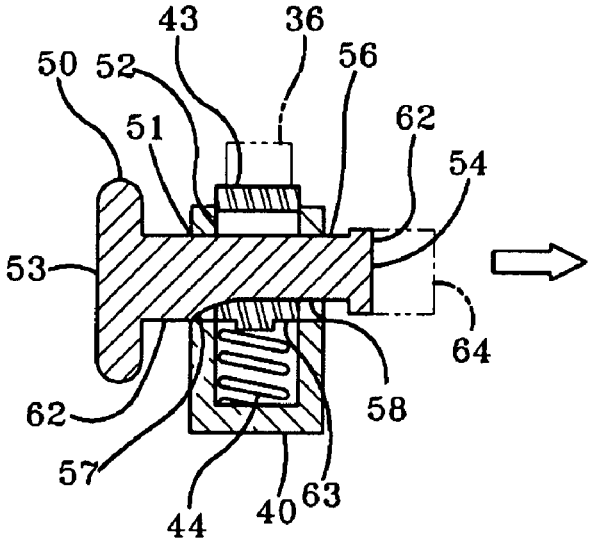
FIGS. 5A and 5B are sectional views of the joint taken along line B-B of FIG. 4 illustrating operation of the joint.
Figure 5B:
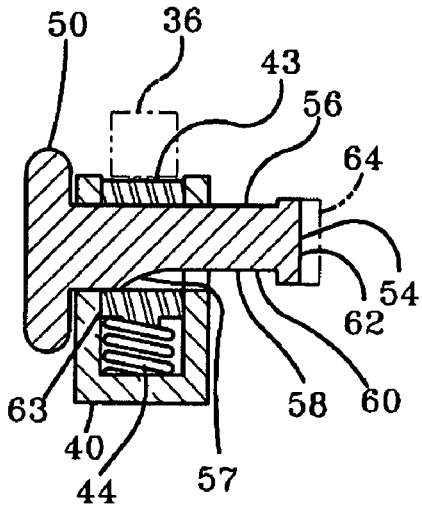

Referring now to FIGS. 3-5, a description of one embodiment of the joint 30 will be given. The joint 30 comprises two skeleton frames 32A, 32B attached to the connected components of the rib 16 (i.e., support legs 18, outer roof members 20A, and inner roof member 20B) and a hinge 34. It is desirable that all the joints 30 in the frame 12 be substantially similar such that the only difference in the joints 30 is in the angle formed between adjacent components connected by the joint 30 in the rib 16 when in the erected condition.

One skeleton 32A has a male hook part 36 with a hook point 38. The male hook part 36 is desirably attached to the skeleton with screws 39 or other suitable fastener or glue. The other skeleton 32B has a female hook body 40 attached thereto with screws 39 or other suitable fasteners or glue. The female hook body 40 receives a slide 42 having an inclined front face 43 and a spring 44 that pushes against the slide 42 such that the front face 43 protrudes past the front of the female hook body 40. An unlocking member 50 that is used to unlock the joint 30 is received through openings 51, 52 in the sides of the female hook body 40 and the slide 42 respectively. The unlocking member 50 has a substantially flat push button 53 with an actuation arm 54 extending from the rear surface thereof. As best seen in FIG. 5, the actuation arm 54 has a flat front face 56 and a sloping contact zone 57 in its rear face 58 such that a distal end 60 is narrower than a proximal end 62 of the arm with the sloping contact zone 57 intermediate the distal and proximal ends 60, 62.

When the unlocking member 50 is in a first or locked position, the narrower distal end 60 of the actuation arm is adjacent the slide 42 and the rear face 58 contacts a rear portion 63 of the slide. The biasing force of the spring 44 presses the slide 42 up against the rear face 58 such that the inclined front face 43 of the slide 42 extends past the front of the female hook body 40. Because the actuation arm 54 is narrower at the distal end 60, the slide 42 is able to travel forward a distance sufficient to permit the front face 43 to extend out of the female hook body 40. In this position, the inclined face 43 of the slide 42 mates with the hook point 38 of the male hook part 36 in a locked condition as shown in FIGS. 3 and 5A.

When moving the joint 30 to the locked position while setting up the shelter 10, the components of the rib 16 are positioned to the erect position. As the joint 30 is moved to this position, the male hook part 36 on skeleton frame 32A moves toward the female hook body 40 such that the hook point 38 contacts and presses against the inclined face 43 of the slide 42. As the male hook part 36 moves downward over the inclined face 43 of the slide 42, the slide 42 is pushed rearward against the biasing force of the spring 44 with respect to the female hook body 40 until the hook point 38 clears the inclined face 43. When this happens, the spring 44 forces the slide 42 back against the inner face of the male hook part 36 such that the hook point 38 catches the slide 42 in the locked condition such that the skeleton frames 32A, 32B are prevented from pivoting about the hinge 34. As can be seen, the joint 30 automatically locks itself when it is moved into the locked condition simply by moving the skeleton frames 32A, 32B into position.

When the shelter 10 needs to be folded, the joint 30 is released and opened by pressing on the push button 53 to reposition the actuating arm 54. As the actuation arm 54 is repositioned, the intermediate sloped portion 57 of the actuation arm 54 begins to press on the rear portion 63 of the slide 42 and forces the slide rearward against the biasing force of the spring 44. When the push button 53 is pressed fully, the wider proximal end 62 of the actuation arm 54 forces the slide 42 back against the spring 44 a sufficient distance so that the inclined face 43 moves clear of the hook point 38, allowing the male hook part 36 to disengage from the slide 42. The skeleton frames 32A, 32B can then be freely rotated about the hinge 34 to fold the rib 16.

As the skeleton frames 32A, 32B are rotated, a tip 62 of the actuation arm 54 contacts a curved return pad 64 on the skeleton frame 32A. The return pad 64 is configured to force the actuation arm 54 to move back to the position where the narrower distal end 60 of the arm is adjacent the slide 42 so that it is in position to automatically lock the next time the joint 30 is operated. Desirably, the return pad 64 causes the actuation arm 54 to move such that the slide 42 contacts the actuation arm 54 in the sloped contact zone 57 at which time force from the spring 44 takes over and causes the actuation arm 54 to continue moving.

As mentioned above, this joint 30 helps the lock of frame 12 of shelter 10 in the erect condition and prevents inadvertent unlocking. Desirably, when the frame 12 of shelter 10 is spread, the joints 30 automatically lock. When the frame 12 of shelter 10 is folded, the joints 30 are unlocked by pressing the push button 50 thereby allowing the ribs 16 of the frame 12 to be folded. It can be seen that the frame 12 of the shelter 10 may therefore be erected and taken down without the use of any additional tools. One skilled in the art will recognize however that other locking joints may be used in the frame 12 using sound engineering judgment.

Figure 6:
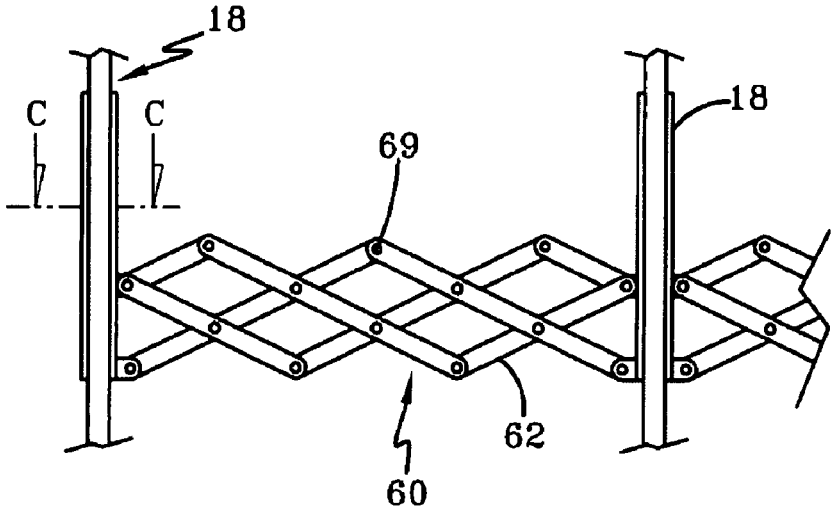
FIG. 6 shows a side view of the frame with the X-connection system.
Figure 7:
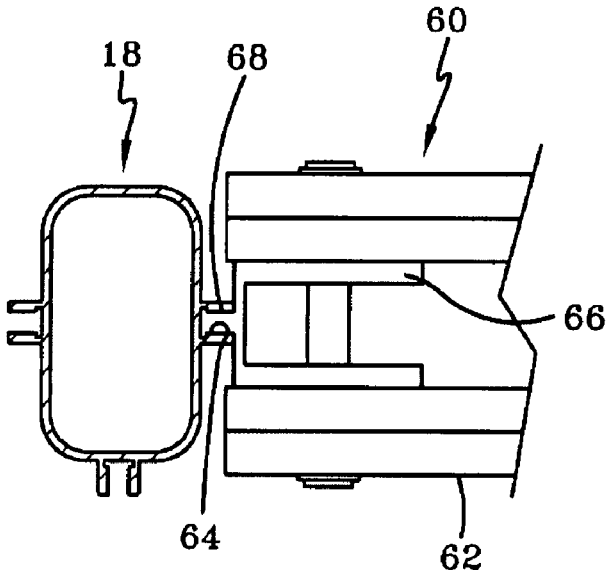
FIG. 7 is a section view of the support leg and X-connection system of FIG. 6.

Turning now to FIG. 6, support legs 18 of adjacent ribs 16 are connected with a wall support 60 extending along the length of the shelter 10 that can be spread to erect the shelter 10 and collapsed to take down the shelter 10. In one embodiment, the wall support 60 is a dual X-connection system made of a plurality of crossing connection members 62. Turning also now to FIG. 7, the figures show how the support leg 18 and X-connection system 60 works. The support leg 18 has a guide 64. In one embodiment, the guide 64 is a groove formed in the support leg 18. One end of the X-connection system 60 has a slide block 66 with a runner 68 that is slideably mounted in this guide 64. The other end of the X-connection system 60 is fixed to the support leg 18. Therefore one end of the X-connection system 60 moves freely upward or downward during folding and spreading of the X-connection system 60 to position the adjacent ribs 16. Intersections of the connection members 62 are connected at cross points 69 which connects the outside and inside connection members 62 to permit a durable support yet allow for smooth movement.

When the space between adjacent ribs 16 needs to be reduced, such as when collapsing the shelter 10, the slide block 66 moves upward through the guide 64 and then, connection members 62 come close to a vertical angle (90 degrees). When the distance between adjacent ribs 16 needs to be widened, such as when erecting the shelter 10, the slide block 66 moves downward through the guide 64 so that the connection members 62 come close to a horizontal angle (180 degree). Therefore, moving adjacent ribs 16 closer together causes the slide block 66 to move in the guide 64 in one direction causing the connection members 62 of the X-connection system 60 to be positioned in a substantially vertical condition and moving adjacent ribs further apart causes the slide block 66 to move in the guide 64 in an opposite direction causing the connection members 62 of the X-connection system 60 to be positioned in a more horizontal condition.

Figure 8:
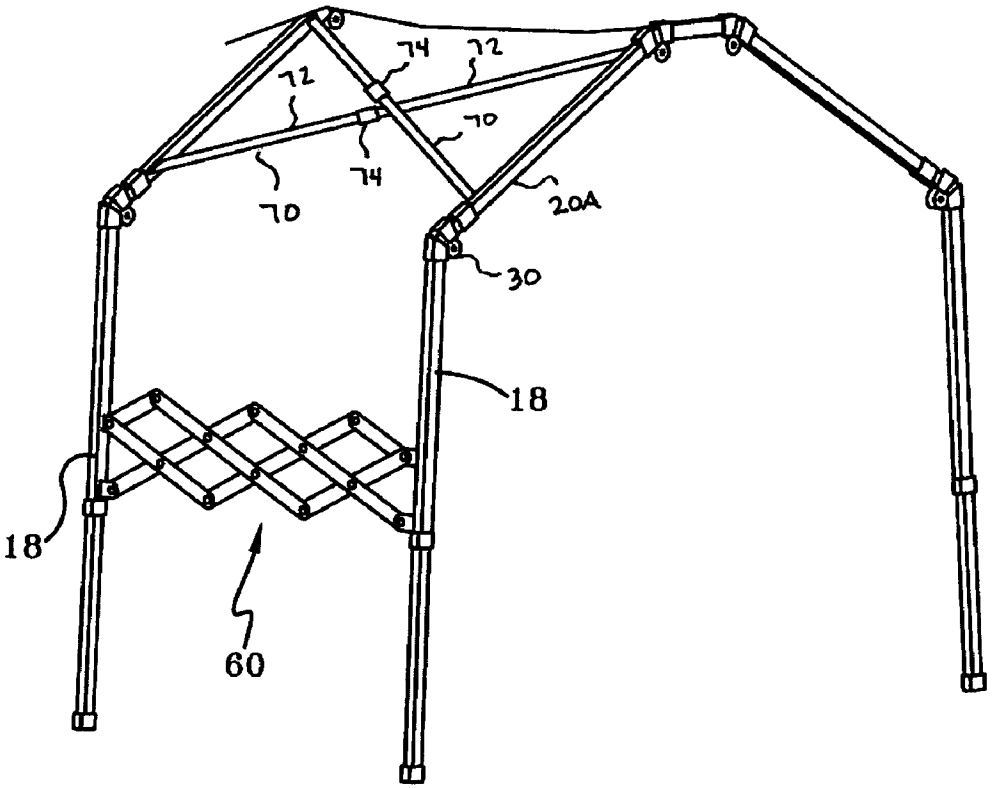
FIG. 8 shows a side view of the roof cross frame poles and locking collar and swivel lock connection.
Figure 9:
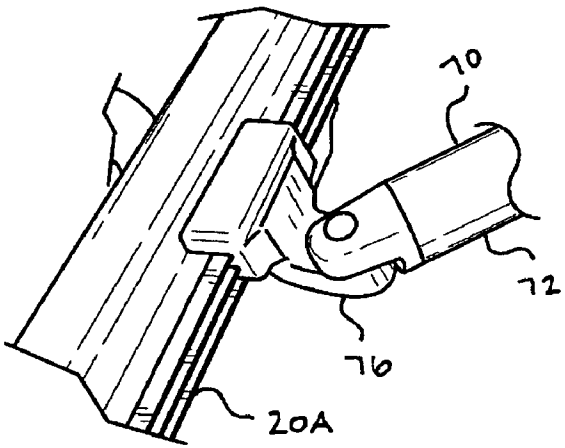
FIG. 9 shows the swivel joint of the frame.

Referring now to FIG. 8, there are two cross frame poles 70 connecting the outer roof members 20A of adjacent ribs 16. These poles 70 telescope open upon deployment to provide support on each side of the roof frame. Each cross frame pole 70 comprises two members 72 and a locking collar 74 that is tightened when the frame is extended. These poles 70 attach at one end to the frame 12 with a swivel mechanism 76 as seen in FIG. 9.

After understanding these components, it becomes apparent how to erect and to fold and pack the shelter 10. In order to fold the shelter, the height of shelter 10 is reduced by positioning the lower portion 24 of each leg 18 inside the upper portion 22. The shelter 10 is collapsed in the length or longitudinal direction or the shelter 10 by collapsing the X-connection system 60 to bring adjacent ribs 16 into close proximity. Then, the individual ribs 16 are collapsed in the width or transverse direction of the shelter 10 by unlocking the joints 30 and moving the legs 18 and roof members 20A to the collapsed position illustrated in phantom in FIG. 2.

To set up the shelter 10, the individual ribs 16 are expanded in the width or transverse direction by moving the legs 18 and roof members 20A to the erected position illustrated in FIG. 2 and locking the joints 30. The shelter 10 is then expanded in the length or longitudinal direction by expanding the X-connection system 60 to spread adjacent ribs 16. The frame 12 is raised by pulling the lower portion 24 of each leg 18 from the upper portion 22. The canopy 14 can be installed inside or outside of the frame 12 as desired.

With the explanation above, it is evident that this system is not complicated, but provides a much more durable and stable shelter 10, based on the following:

1. The shelter 10 is pre-assembled and all parts are connected in the frame 12. This one piece frame 12 can then be folded.

2. There is a reinforced dual X-connection system 60 which gives extra strength lengthwise where the most pressure is directed. It provides strength and durability against lateral forces such as high winds or rain.

Therefore, this shelter 10 can be used anywhere rescue operations are required, such as irregular surfaces or terrain. It can be used during inclement weather conditions for outdoor shelter, rescue shelter, and event shelter. With minimal personnel, training and in a short time period, this shelter 10 can be deployed and/or taken down.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A portable shelter having a frame that is separately collapsible in a transverse direction and a longitudinal direction of the shelter to facilitate transportation and storage of the shelter, the frame comprising:

a plurality of ribs, each rib comprising two support legs and a plurality of roof members forming a generally inverted U-shape when in an erect configuration, wherein the support legs and the roof members are connected with foldable joints such that each rib may be collapsed in the transverse direction to a collapsed configuration wherein width of the rib is narrower in the collapsed configuration than when in the erect configuration; and a wall support system connecting adjacent ribs, wherein the wall support system is collapsible in the longitudinal direction to adjust the relative position between adjacent ribs;

wherein said foldable joint comprises first and second skeleton frames connected with a hinge, wherein the first skeleton frame has a male hook part with a hook point and the second skeleton frame has a female hook body that receives a slide having an inclined front face and a spring that pushes against the slide such that the front face protrudes past the front of the female hook body and wherein an unlocking member is received through openings in the sides of the female hook body and the slide, the unlocking member having a substantially flat push button with an actuation arm extending from the rear surface thereof.

2. The shelter of claim 1 wherein the wall support system is an X-connection system made of a plurality of crossing elongate connection members, wherein one end of each side of the X-connection system has a slide block with a runner that is slideably mounted in a guide in a support leg and the other end of each side of the X-connection system is fixed to the support leg such that one end of the X-connection system moves freely upward or downward relative the other end to permit expanding and narrowing of the X-connection system to adjust the relative position of adjacent ribs.

3. The shelter of claim 2 wherein the support leg has first and second portions, wherein the second portion can be inserted into the first portion.

4. The shelter of claim 3 wherein each rib has two outer roof members that are of a length substantially equal to the length of the first leg portions and a third shorter middle roof member positioned in-between the two outer roof members configured to enable the rib to be folded such that the support legs are folded inward to be adjacent the outer roof members and the outer roof members are folded with respect to the inner roof member such that the support legs and roof members are adjacent each other and in a generally parallel condition.

5. The shelter of claim 4 wherein moving adjacent ribs closer together causes the slide block to move in the guide in one direction causing the connection members of the X-connection system to be positioned in a substantially vertical condition and moving adjacent ribs further apart causes the slide block to move in the guide in an opposite direction causing the connection members of the X-connection system to be positioned in a more horizontal condition.

6. The shelter of claim 1 further comprising a canopy, wherein the canopy is attached to either on the outside of the frame or on the inside of the frame.

7. The shelter of claim 1 wherein the actuation arm has a flat front face and a sloping contact zone in its rear face such that a distal end is narrower than a proximal end.

8. The shelter of claim 7 wherein when the unlocking member is in a first or locked position, the narrower distal end of the actuation arm is adjacent the slide and the biasing force of the spring presses the slide against the rear face such that the inclined front face of the slide extends past the front of the female hook body such that the inclined face of the slide mates with the hook point of the male hook part in a locked condition.

9. The shelter of claim 8 wherein as the joint is moved to a locked position, the male hook part moves toward the female hook body such that the hook point contacts and presses against the inclined face of the slide such that the slide is pushed rearward against the biasing force of the spring with respect to the female hook body until the hook point clears the inclined face and the spring forces the slide back against an inner face of the male hook part such that the hook point catches the slide in the locked condition such that the skeleton frames are prevented from pivoting about the hinge.

10. The shelter of claim 9 wherein said joint is unlocked by pressing on the push button to reposition the actuating arm.

11. The shelter of claim 10 wherein as the actuation arm is repositioned, the intermediate sloped portion of the actuation arm presses on the rear portion of the slide and forces the slide rearward against the biasing force of the spring.

12. The shelter of claim 11 wherein when the push button is pressed fully, the wider proximal end of the actuation arm forces the slide back against the spring a sufficient distance so that the inclined face moves clear of the hook point, allowing the male hook part to disengage from the slide such that the skeleton frames can then be rotated about the hinge to fold the rib.

13. The shelter of claim 12 wherein the joint further comprises a return pad, wherein as the skeleton frames are rotated, a tip of the actuation arm contacts the return pad so as to force the actuation arm to move back to the position where the narrower distal end of the arm is adjacent the slide.

* * * * *